US010415299B2

(12) United States Patent
Mitchell

(10) Patent No.: US 10,415,299 B2
(45) Date of Patent: Sep. 17, 2019

(54) ADJUSTABLE SHIM AND PRE-HUNG DOOR WITH THE SAME

(71) Applicant: Endura Products, Inc., Colfax, NC (US)

(72) Inventor: Michael K. Mitchell, Winston-Salem, NC (US)

(73) Assignee: Endura Products, Inc., Colfax, NC (US)

( * ) Notice: Subject to any disclaimer, the term of this patent is extended or adjusted under 35 U.S.C. 154(b) by 0 days.

(21) Appl. No.: 15/850,962

(22) Filed: Dec. 21, 2017

(65) Prior Publication Data

US 2018/0187475 A1 Jul. 5, 2018

Related U.S. Application Data

(60) Provisional application No. 62/439,925, filed on Dec. 29, 2016.

(51) Int. Cl.

| | |
|---|---|
| ***E06B 1/04*** | (2006.01) |
| ***E04F 21/00*** | (2006.01) |
| ***E06B 1/60*** | (2006.01) |
| ***E06B 1/52*** | (2006.01) |
| ***E06B 1/02*** | (2006.01) |
| *E06B 3/70* | (2006.01) |

(52) U.S. Cl.

CPC ..... *E06B 1/6069* (2013.01); *E04F 21/0015* (2013.01); *E06B 1/02* (2013.01); *E06B 1/52* (2013.01); *E06B 2003/7098* (2013.01)

(58) Field of Classification Search

CPC ..... E04F 21/0015; E06B 1/02; E06B 1/52; E06B 1/6069; E06B 2003/7098

USPC ..... 52/217

See application file for complete search history.

(56) References Cited

U.S. PATENT DOCUMENTS

| | | | | |
|---|---|---|---|---|
| 2,524,961 | A | 10/1950 | Cramer | |
| 3,250,049 | A | 5/1966 | Sklar | |
| 3,571,996 | A * | 3/1971 | Braswell | E06B 1/6069 49/505 |
| 3,992,833 | A | 11/1976 | Hulinsky | |
| 4,232,068 | A | 11/1980 | Hoh et al. | |
| 4,637,183 | A | 1/1987 | Metz | |
| 4,731,965 | A | 3/1988 | Jensen | |
| 4,739,561 | A | 4/1988 | Mills | |
| 4,858,386 | A | 8/1989 | Nail | |
| 5,054,250 | A | 10/1991 | Foss | |
| 5,566,414 | A | 10/1996 | Nonaka | |

(Continued)

FOREIGN PATENT DOCUMENTS

| | | |
|---|---|---|
| WO | 2012155908 | 11/2012 |

OTHER PUBLICATIONS

Truth Hardware catalog, Windows & Doors, Jamb Jacks, known at least as early as Jan. 14, 2016, 4 pgs.

*Primary Examiner* — Joshua J Michener
*Assistant Examiner* — James J Buckle, Jr.
(74) *Attorney, Agent, or Firm* — Womble Bond Dickinson (US) LLP

(57) ABSTRACT

An adjustable shim for pre-hung doors or windows is described. The adjustable shim includes a base bracket configured for mounting to a frame member of the pre-hung door or window. The adjustable shim also includes a shim plate and an actuator operably attached between the base bracket and the shim plate. Rotation of the actuator raises or lowers the shim plate relative to the base bracket.

14 Claims, 13 Drawing Sheets

(56) References Cited

U.S. PATENT DOCUMENTS

| | | | | |
|---|---|---|---|---|
| 5,655,342 | A * | 8/1997 | Guillemet | E06B 1/60 49/505 |
| 5,655,343 | A * | 8/1997 | Seals | E06B 1/603 49/505 |
| 6,018,916 | A | 2/2000 | Henry | |
| 6,167,663 | B1 | 1/2001 | Nakamoto et al. | |
| 6,216,402 | B1 * | 4/2001 | Van de Laar | E06B 1/6069 52/204.56 |
| 6,966,119 | B1 * | 11/2005 | Dlugoleski | G01C 9/26 33/194 |
| 7,331,146 | B1 | 2/2008 | Beutler et al. | |
| 7,537,819 | B2 | 5/2009 | Hendricks | |
| 7,987,637 | B2 | 8/2011 | Smith | |
| 8,813,437 | B1 | 8/2014 | Spofford | |
| 9,010,065 | B2 | 4/2015 | Brown | |
| 9,010,704 | B2 | 4/2015 | Sirke et al. | |
| 9,194,170 | B2 | 11/2015 | Therma-Tru | |
| 2008/0075556 | A1 | 3/2008 | Smith | |
| 2008/0276421 | A1 | 11/2008 | Vanderpan | |
| 2010/0058678 | A1 * | 3/2010 | Lutz | E06B 1/6069 52/126.1 |
| 2014/0190119 | A1 | 7/2014 | Brown | |

* cited by examiner

ADJUSTABLE SHIM AND PRE-HUNG DOOR WITH THE SAME

PRIORITY

The present application claims priority to U.S. provisional application 62/439,925 filed on Dec. 29, 2016. The '925 application is incorporated herein by reference in its entirety.

TECHNICAL FIELD

The present disclosure relates to building products and components for simplifying installation of building products. More particularly, the present disclosure relates to an adjustable shim for assisting with the installation of pre-hung doors or windows.

BACKGROUND

Builders or contractors often install an exterior door using a pre-hung door. As shown in FIG. 1, a typical pre-hung door 10, includes a frame 12 and a door panel 14. The frame 12 typically includes a threshold 16, a header 18, a latch-side jamb 20, and a hinge-side jamb 22. A plurality of hinges (not shown) generally mount the door panel 14 to the hinge-side jamb 22. The pre-hung door 10 may then be installed within a rough opening 24 of an enclosure defined by at least a pair of studs 26 and a cross beam 28. Sheathing 30, such as oriented strand board (OSB) or plywood, may be applied around the rough opening 24 adjacent to the exterior thereof, and sheet rock (not shown) may be applied around the interior of the rough opening.

Pre-hung doors 10, also referred to as door units, are often preferred over separately hanging slab doors, especially for exterior entryways. Pre-hung doors 10 may be preferred because they are pre-assembled to provide a tight fitting, substantially watertight, seal between the frame 12 and the door panel 14. Pre-hung doors 10, however, can lack rigidity prior to installation. Thus, portions of pre-hung doors 10 have been found to bend, bow, twist, expand, contract, or otherwise shift during shipping, handling, and installation. These changes can reduce the quality of the pre-assembled seal between the frame 12 and the door panel 14. Returning to proper alignment and spacing between the door panel 14 and the surrounding frame 12 can be highly dependent upon installation practices and the skill of the installers.

To support and position the pre-hung door 10 within the rough opening 24, wooden tapered shim pairs are conventionally used between the frame 12 and the studs 26 or cross beam 28. The tapered shim pairs may be used at several locations around the frame 12 to correspond with locations where the frame 12 is fastened to the rough opening 24.

There remains a need for an adjustable shim capable of adding support between the outside face of the frame 12 and an opposing inside face of the studs 26 or cross beam 28, such that a pre-hung door 10 may be more easily and accurately supported and positioned within a rough opening 24.

SUMMARY

One embodiment of the present disclosure includes an adjustable shim. The adjustable shim comprises a base bracket configured for mounting to a frame member of a pre-hung door or window. The adjustable shim also includes a shim plate and an actuator operably attached between the base bracket and the shim plate. Rotation of the actuator raises or lowers the shim plate relative to the base bracket.

Another embodiment of the present disclosure includes a pre-hung door comprising a frame, a door panel hinged to the frame, and at least one adjustable shim attached to the frame. The at least one adjustable shim comprises a base bracket mounted to the frame, a shim plate, and an actuator operably attached between the base bracket and the shim plate. Rotation of the actuator raises or lowers the shim plate relative to the base bracket.

Another embodiment of the present disclosure includes a method of installing a pre-hung door. The method comprises positioning the pre-hung door within a rough opening of a building, wherein the pre-hung door comprises at least one frame member, a door panel, and at least one adjustable shim mounted on a back face of the at least one frame member. The method then includes rotating a first actuator to raise a shim plate of the at least one adjustable shim relative to the back face of the at least one frame member at least until the shim plate contacts a portion of the rough opening. The method also includes attaching the at least one adjustable shim to the rough opening and rotating a second actuator to adjust the pre-hung door relative to the rough opening along a plumb direction.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Embodiments of the present disclosure include an adjustable shim for attachment to a pre-hung door or a rough opening for controlling a margin therebetween. Other embodiments of the present disclosure include methods of installing a pre-hung door within a rough opening in a building using at least one adjustable shim for controlling the margin therebetween.

Figure 2:
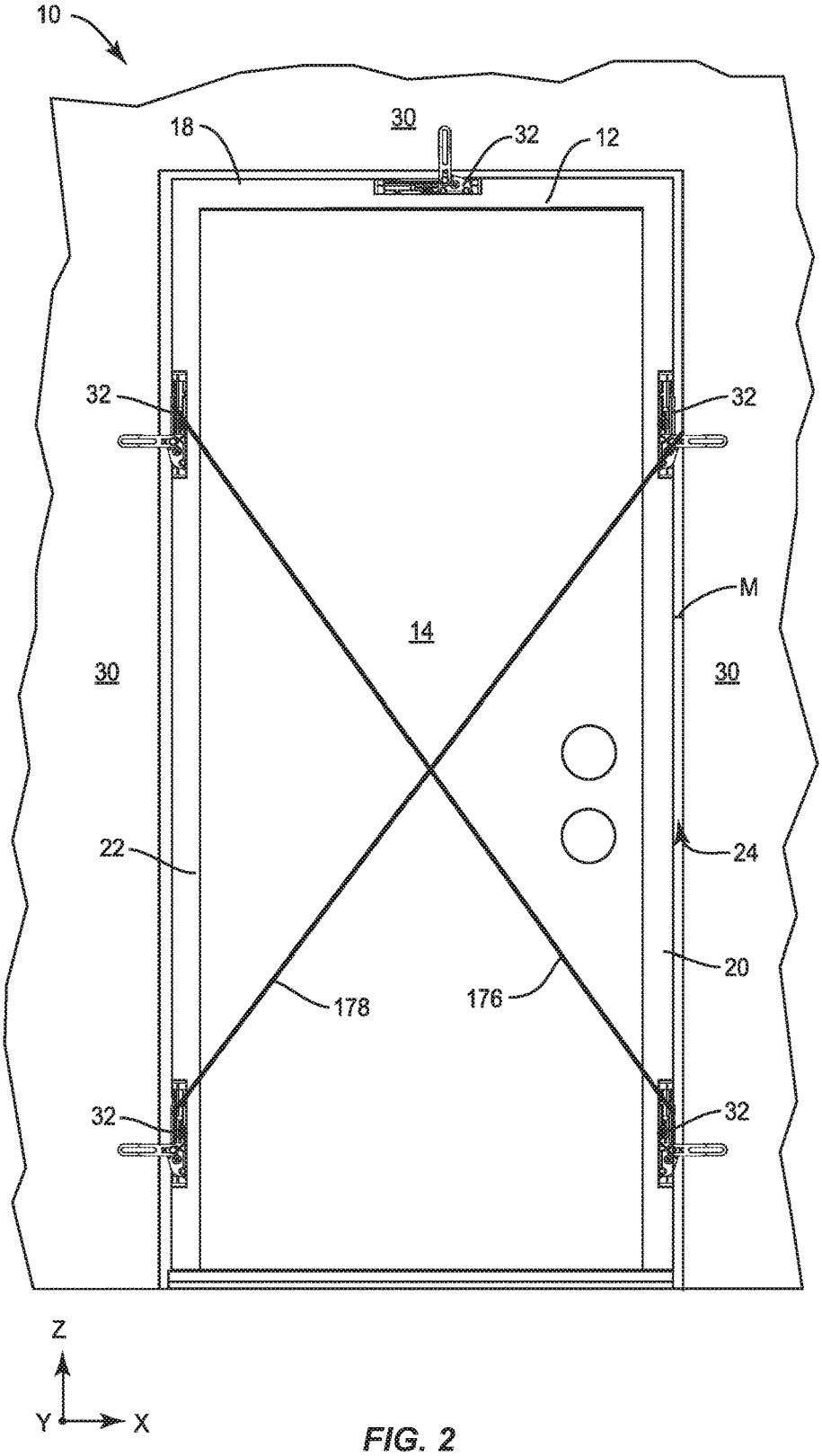
FIG. 2 is a plan view of a pre-hung door installed in a rough opening using a plurality of adjustable shims according to an embodiment of the present disclosure.

With reference to FIG. 2, the pre-hung door 10 is shown installed within a rough opening 24 with the assistance of a plurality of adjustable shims 32. In addition to the pre-hung door 10, the shims 32 as described herein may also be useful for installing windows within rough openings. Windows may include a similar frame as pre-hung doors, where the door panel is replaced by a glass pane that is fixed or movable relative to the frame.

In the illustrated embodiment of FIG. 2, shims 32 are provided with two on either side of the frame 12, near the upper and lower ends of the frame respectively. Use of additional shims 32 along the height of the frame 12 is also possible. Use of one or more shims 32 along the header 18 is also possible. The shims 32 are designed to take up the space, and provide support, between the frame 12 and the interior surfaces of the rough opening 24. This space may be referred to as the margin M. The direction substantially normal to the back face of the frame 12, and thus normal to the interior surfaces of the rough opening 24, along which the magnitude of the margin M is measured, may be referred to as the margin direction. The margin direction is along the X-axis of FIG. 2 for shims 32 on the jambs 20, 22, and the margin direction is along the Z-axis of FIG. 2 for the shim 32 shown on the header 18.

In some embodiments, the shims 32 may also be useful for adjusting portions of the pre-hung door 10 into and out of the rough opening 24 along a direction perpendicular to the margin direction. This direction into and out of the rough opening 24 may be referred to herein as the plumb direction. The plumb direction is along the Y-axis in FIG. 2.

Figure 1:
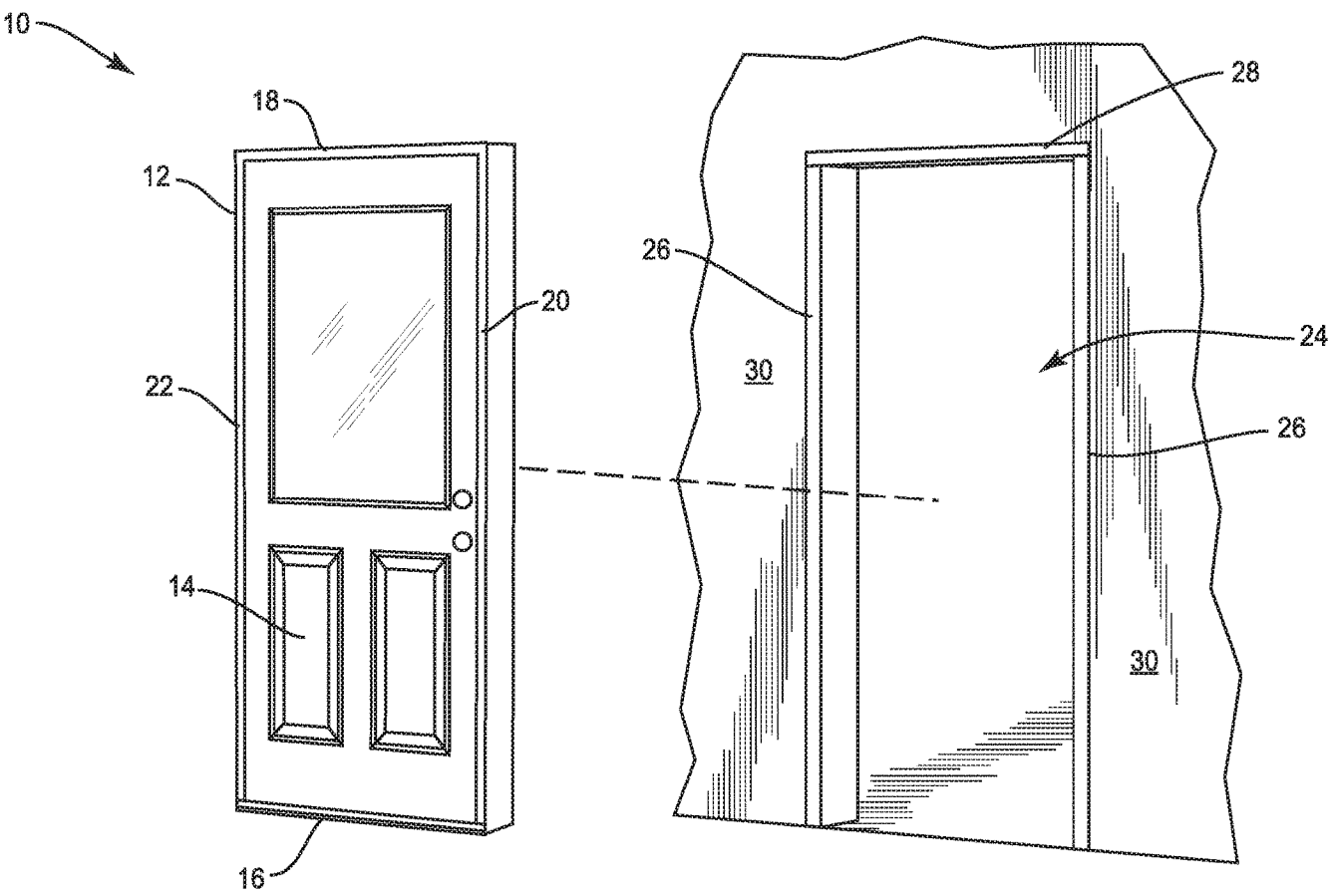
FIG. 1 PRIOR ART
FIG. 1 is an exploded perspective view of a prior art pre-hung door being installed into an exterior rough opening of an enclosure.
Figure 3:
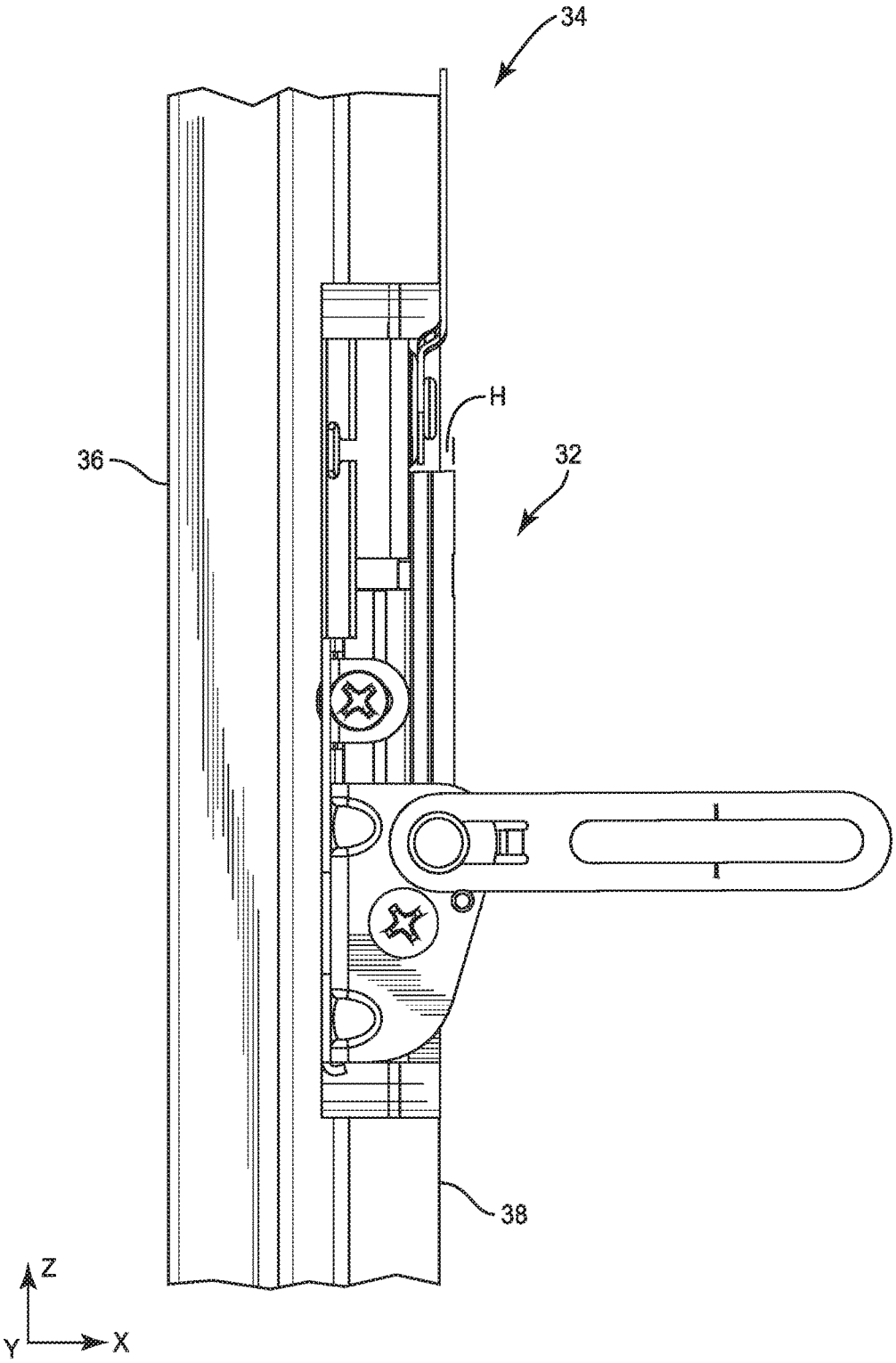
FIG. 3 is a detailed front view of an adjustable shim mounted to a frame member according to a first embodiment.

As mentioned above, the pre-hung door 10 includes a frame 12 having a latch-side jamb 20 and a hinge-side jamb 22. The jambs 20, 22 may be referred to more generally by the term "frame member," to include any generally vertical portion of the frame 12, such as jambs, mullions, astragals, etc., as well as the generally horizontal header 18. As shown in the detailed view of FIG. 3, the frame member (hereafter labeled 34) includes a front face 36 and a back face 38. As used herein, the terms "front" and "back" are used relative to the X-axis or Z-axis, where the front face 36 is directed toward the door panel 14 (FIG. 2) and the back face 38 is directed away from the door panel. The terms "interior" and "exterior" are used in relation to the Y-axis and should be understood relative to the building that defines the rough opening 24 (FIG. 1). The shims 32 described herein could be used with either in-swing or out-swing doors. As shown in FIG. 3, according to one embodiment, the shims 32 may be provided as part of the pre-hung door 10. Therefore, the shims 32, or at least portions thereof, may be mounted to the frame members 34 when the pre-hung door 10 (FIG. 2) arrives on a construction site. In FIG. 3, the shim 32 is shown extended to a shim height H out from the back face 38 of the frame member 34.

Figure 4:
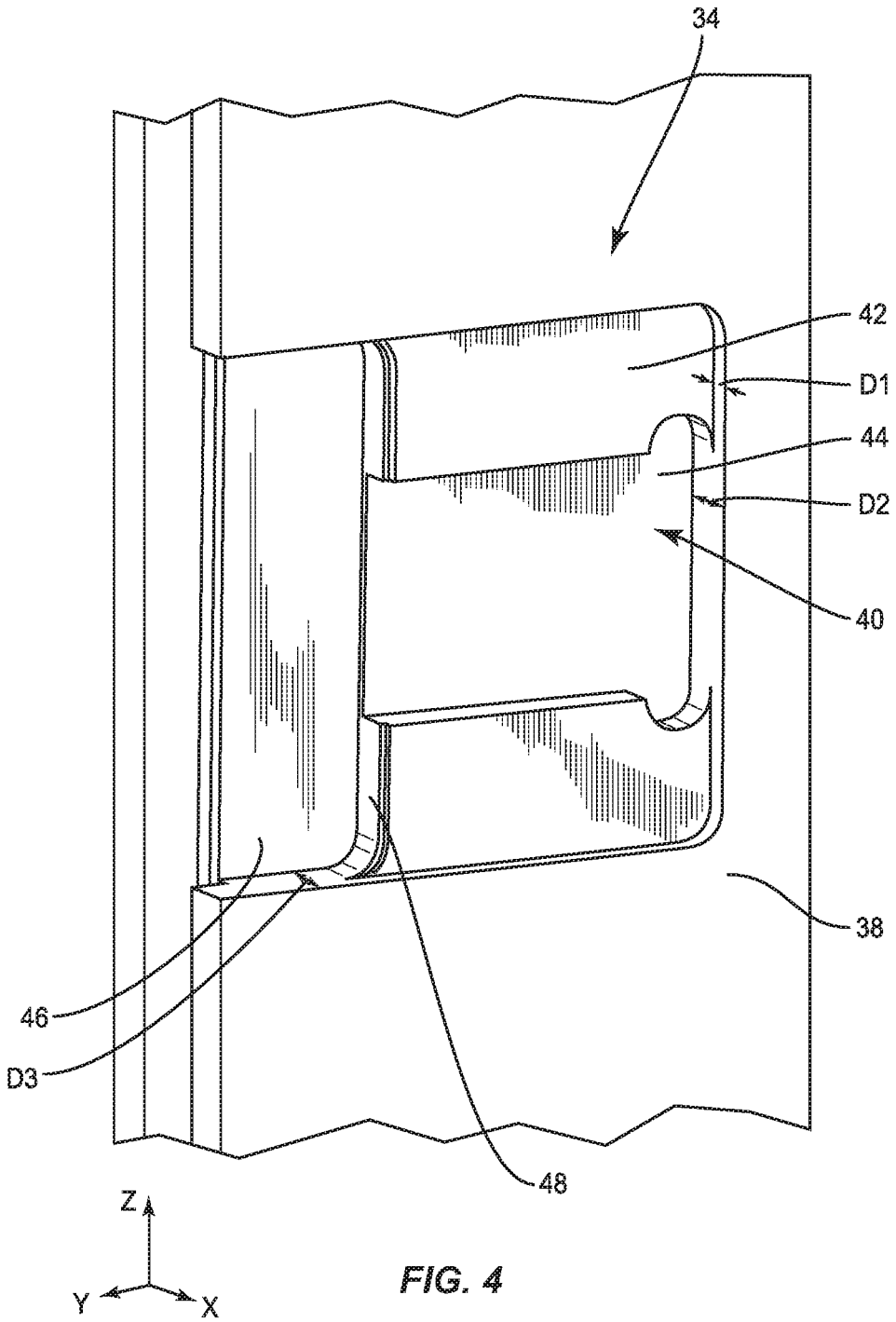
FIG. 4 is a perspective view of the frame member of FIG. 3.

FIG. 4 shows a perspective view of the frame member 34. To accommodate the shim 32 (FIG. 3), the back face 38 of the frame member 34 may include respective receiving recesses 40 formed into the back face. The receiving recesses 40 may include a first surface 42 substantially parallel with the back face 38 and inset from the back face by a distance D1 along the margin direction (X-axis as illustrated). A second surface 44 may be substantially parallel with the back face 38 and offset inward from the back face more than the first surface 42. The second surface 44 may be inset from the back face 38 by a distance D2 along the margin direction. A third surface 46 may be substantially parallel with the back face 38 and inset from the back face by a distance D3. A fourth surface 48 of the receiving recess 40 may be substantially perpendicular to the back face 38 and provide a riser from the third surface 46 to the first surface 42. The arrangement, configuration, and depth of the surfaces 42, 44, and 46 may be configured with the goal of accommodating the shim 32 (FIG. 3) such that the shim 32 may be made flush with the back face 38 in a most contracted state. The shim 32 is preferably capable of being in a position flush with or recessed relative to the back face 38 so that the shim can be used even if the margin M between the frame member 34 and the stud 26 (FIG. 2) is zero. Also, if the shim 32 has a flush position, it is less likely to provide an impediment during transportation of the pre-hung door 10 (FIG. 2).

Figure 5:
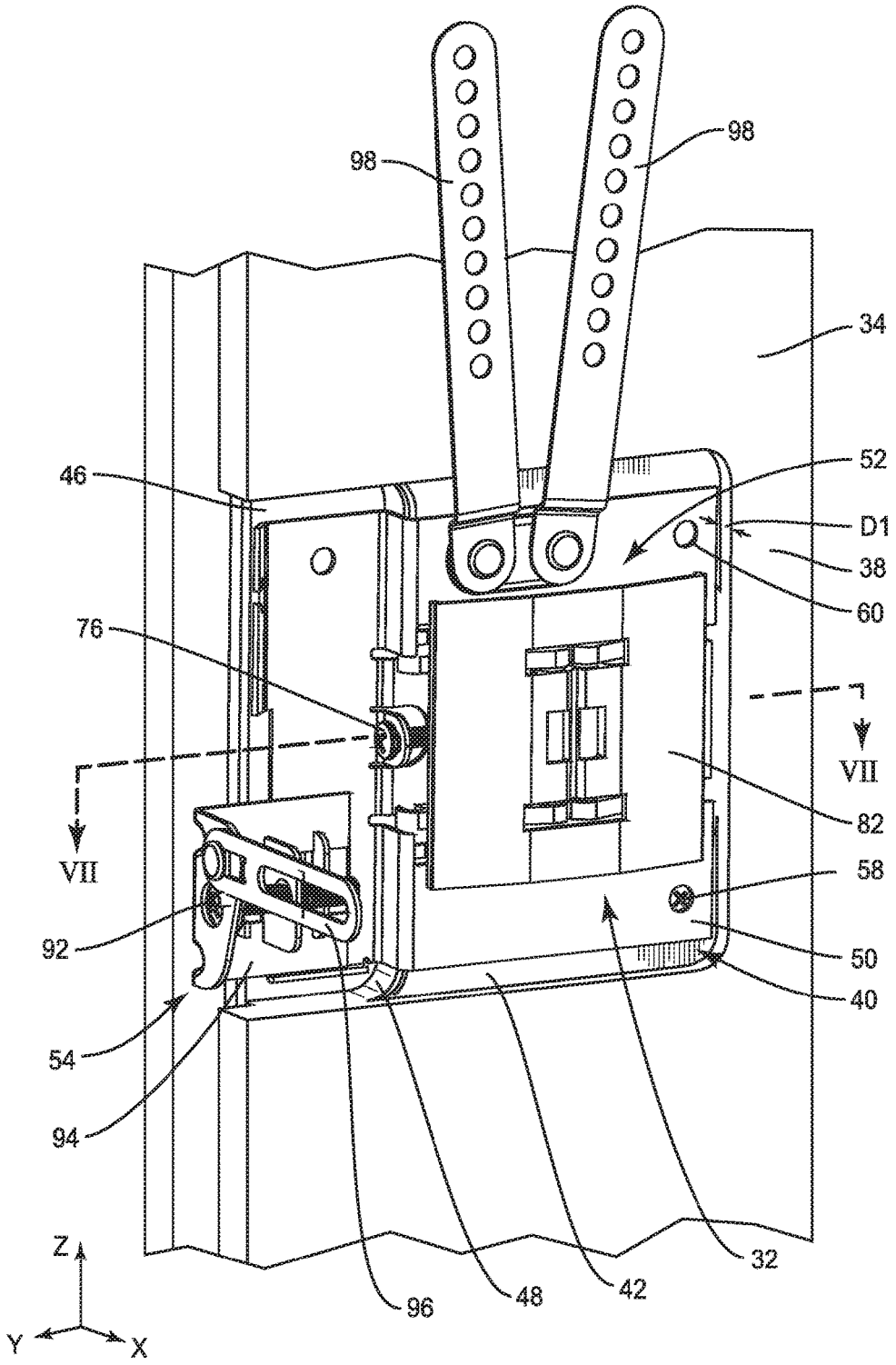
FIG. 5 is a front perspective view of an adjustable shim mounted to a frame member of a pre-hung door according to the first embodiment.

FIG. 5 shows a perspective view of the shim 32 mounted to the frame member 34. One of ordinary skill in the art will appreciate that the shim 32 can be alternatively mounted to a latch-side jamb 20, hinge-side jamb 22, a header 18 (FIG. 2), or a window frame in a similar fashion as described below.

Figure 6:
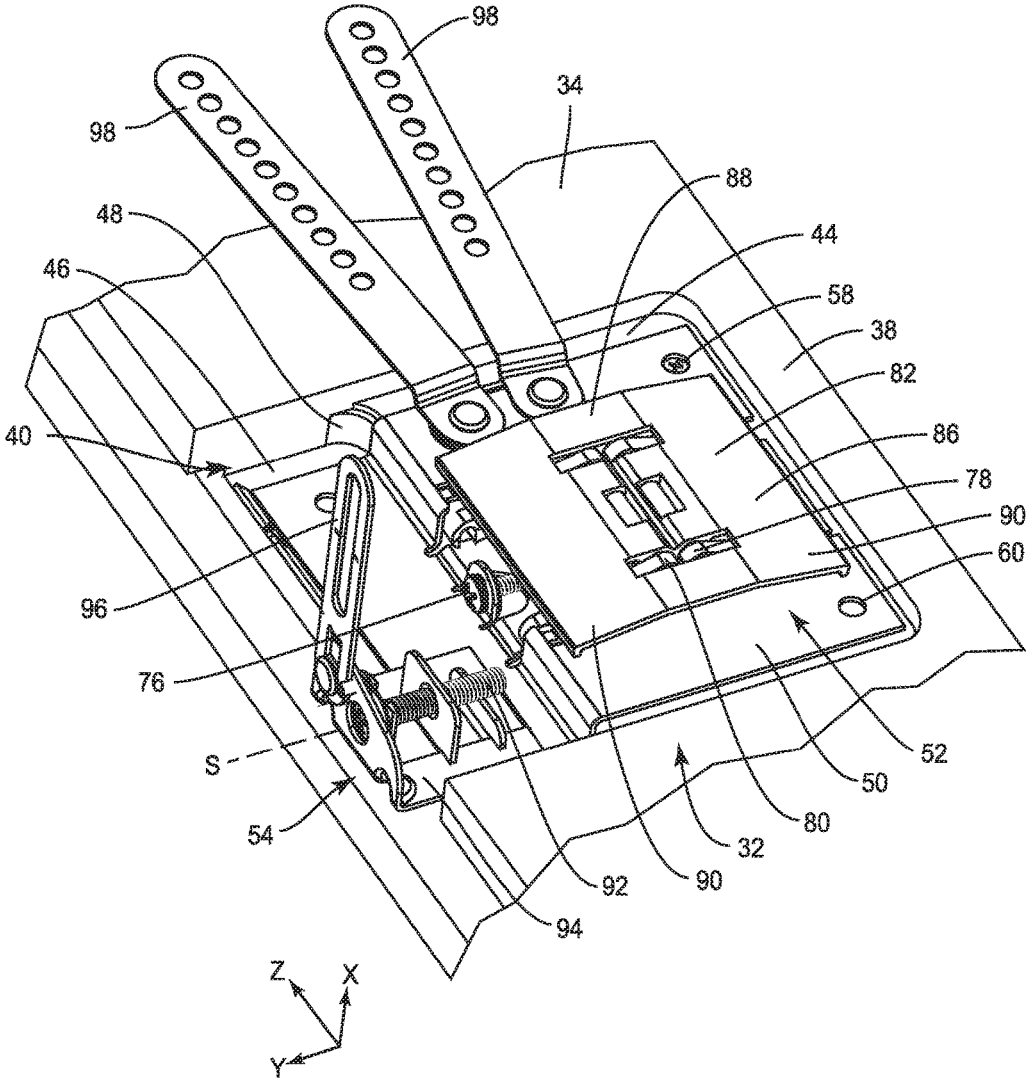
FIG. 6 is a detailed front perspective view of the adjustable shim of FIG. 5.

With reference to FIGS. 5 and 6, the shim 32 may include a base bracket 50 configured to mount the shim to a corresponding frame member 34. The base bracket 50 may support and form part of a margin adjustment assembly 52 and a plumb adjustment assembly 54.

The base bracket 50, and hence the shim 32, may be mounted to the frame members 34 within respective receiving recesses 40 with one or more mounting fasteners 58. The mounting fasteners 58 may pass through one or more mounting apertures 60 provided through the base bracket 50.

Figure 7:
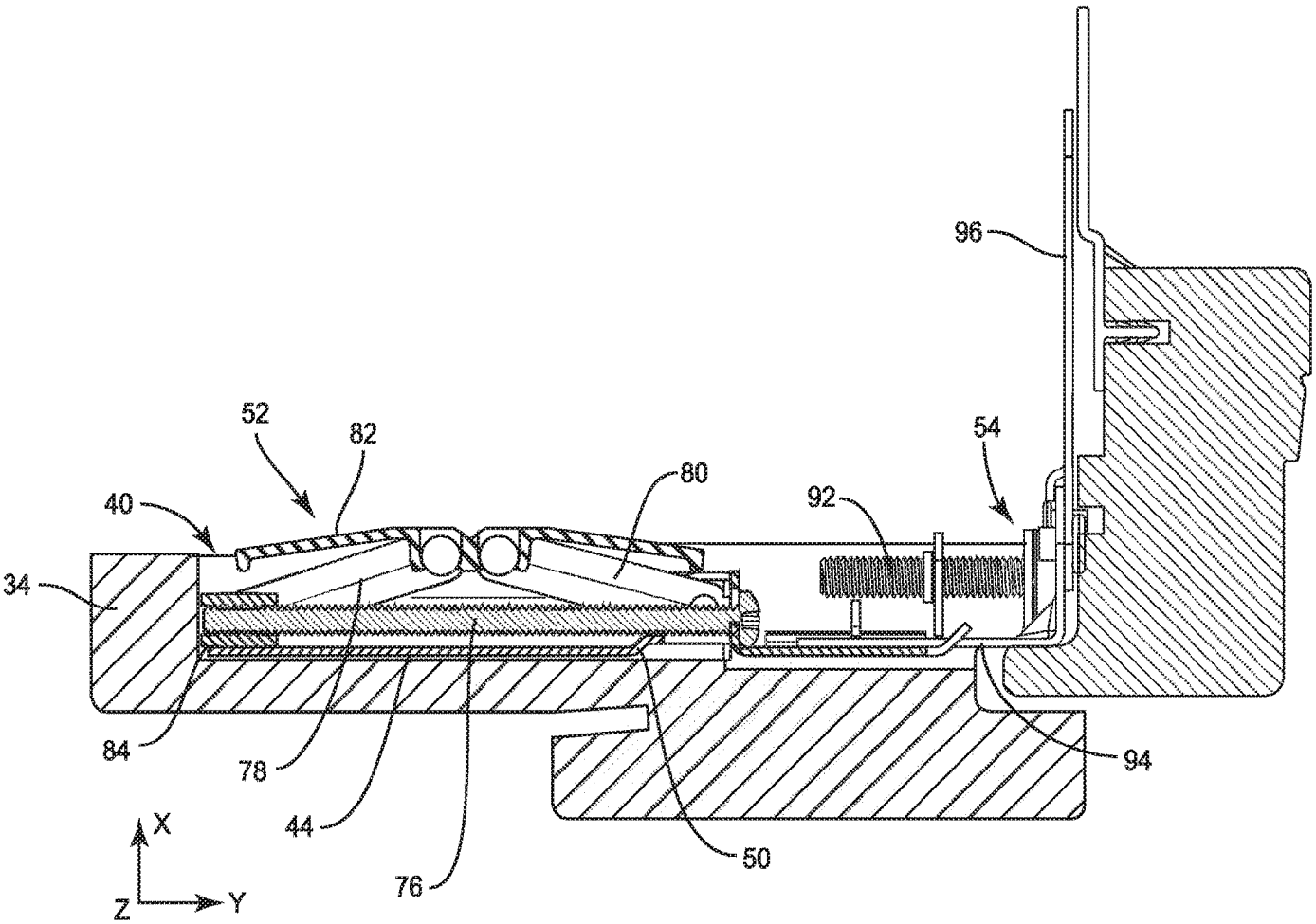
FIG. 7 is a cross sectional view of the adjustable shim take at line VII of FIG. 5.
Figure 8:
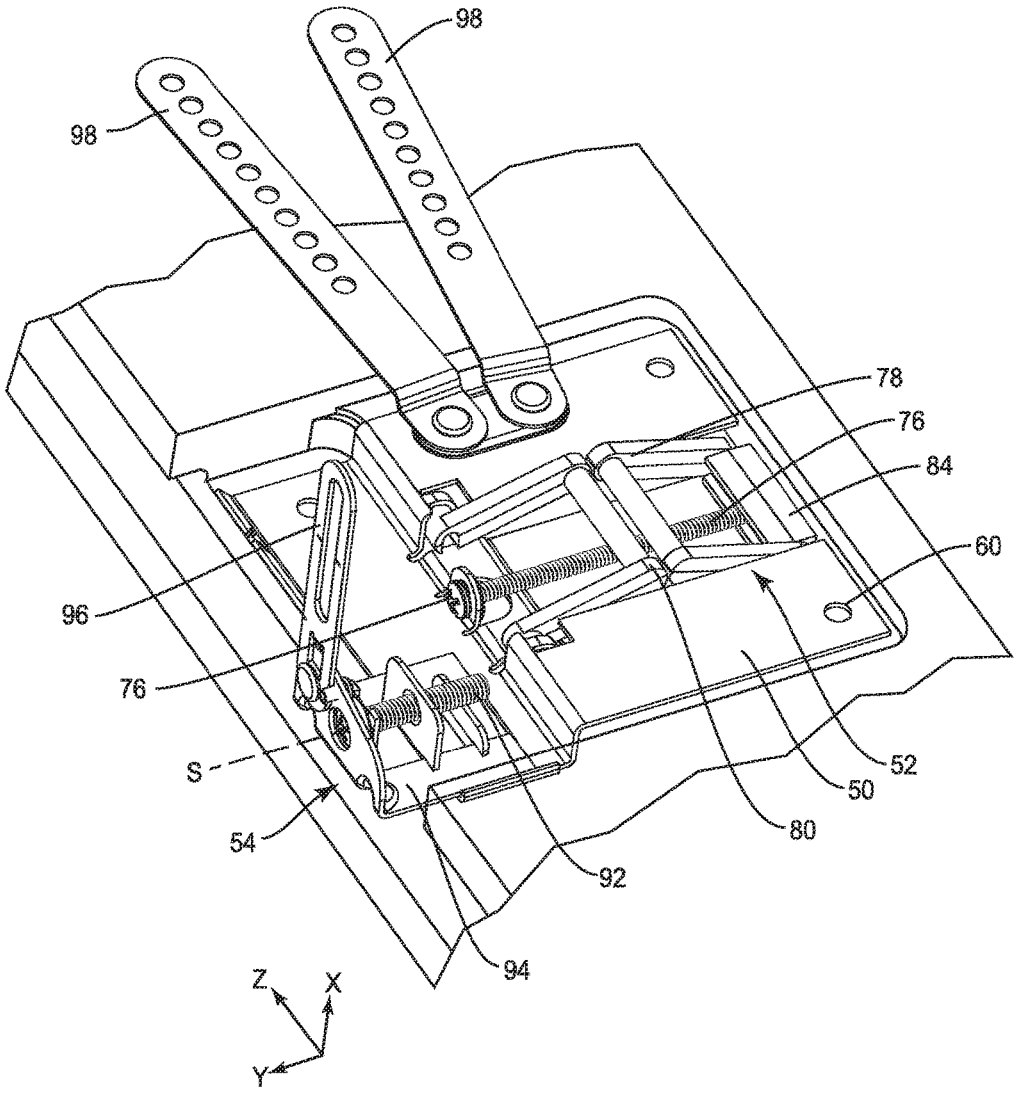
FIG. 8 is a detailed perspective view of the adjustable shim of FIG. 5 with a shim plate removed.

As seen in FIGS. 6-10, the margin adjustment assembly 52 can include an actuator, such as a first adjustment screw 76. The margin adjustment assembly 52 can also include a drive linkage 78, a follower linkage 80, and a shim plate 82. The first adjustment screw 76 can be rotatably attached to the base bracket 50. Rotation of the first adjustment screw 76 may translate a slide block 84 (FIGS. 7 and 8), which can be threadingly attached to the first adjustment screw, relative to the base bracket 50. The slide block 84 (FIG. 8) may form part of a clevis structure. The base bracket 50 may be configured to guide translation of the slide block 84, such as along the second surface 44 of the recess 40 (FIG. 7). The drive linkage 78 can be pivotably attached to the slide block 84 at one end of the drive linkage and pivotably attached to the shim plate 82 at another end of the drive linkage. The follower linkage 80 can be pivotably attached to the shim plate 82 at one end thereof, and pivotably attached to the base bracket 50 at the opposite end thereof. The drive linkage 78 and the follower linkage 80 may be collectively referred to as jack legs. As will be understood by one of ordinary skill in the art, rotation of the first adjustment screw 76 translates the slide block 84 relative to the base bracket 50, which will raise or lower the shim plate 82 relative to the base bracket depending upon the direction of rotation, to adjust the dimensions of the adjustable shim 32 along the margin direction (X-axis as illustrated in FIGS. 6-8).

With reference to FIG. 6, the shim plate 82 may be made from metal or polymer. The shim plate 82 may pivotably attach to the respective drive and follower linkages 78, 80 with a snap-fit or other attachment method. The shim plate 82 may present a shimming surface 86 with a plurality of regions. In the illustrated example, the shimming surface 86 includes a central face 88 flanked by a pair of side faces 90 that are each angled relative to the central face 88 in a direction toward the base bracket 50. The central face 88 is central to the side faces 90 relative to the plumb direction of the pre-hung door 10 (FIG. 2).

In one embodiment, when the shim plate 82 is adjusted to be most near the base bracket 50, the distance between the shimming surface 86 and the first surface 42 may be less than or equal to D1 (FIG. 5) so that the adjustable shim 32 does not extend past the back face 38, providing compact packaging for shipping of the pre-hung door 10 (FIG. 2), and facilitating use of the pre-hung door in a rough opening 24 with zero margin, without needing to remove the adjustable shim(s) 32 from the frame member 34. When the margin adjustment assembly 52 is most extended, the shimming surface 86 may be capable of filling a margin M (FIG. 2) by having a shim height H (FIG. 3) of about five-eighths inch or more.

Returning to FIG. 2, the pre-hung door 10 is plumb when it is vertical along the z-axis and is substantially co-planar with the rough opening 24. The plumb condition of the pre-hung door 10 is adjusted by moving portions of the frame 12 along the y-axis, which is the axis normal to the plane of the pre-hung door 10, i.e. along the plumb direction. This direction of motion may also be referred to as movement into and out of the rough opening 24 along an interior/exterior direction of the building as represented by the y-axis in FIG. 2.

In the illustrated embodiment of FIGS. 5-9, the shim 32 includes a plumb adjustment assembly 54 having a second adjustment screw 92 threadingly attached to the base bracket 50. When the second adjustment screw 92 engages the base bracket 50, the screw axis S (FIG. 6) corresponds with the interior/exterior direction of the building. The plumb adjustment assembly 54 can also include a plumb adjustment bracket 94 configured for guiding translation relative to the base bracket 50. The plumb adjustment bracket 94 can include an attachment bracket 96 configured to extend outward from the frame member 34 and overlap the sheathing 30 (FIG. 2) on the exterior of the rough opening 24. Once the attachment bracket 96 is fixed to the sheathing 30, rotation of the second adjustment screw 92 results in substantially linear movement of the frame 12 (FIG. 2) perpendicular to the face of the sheathing 30.

As seen in FIG. 5, the shim 32 may optionally include securing straps 98. The securing straps 98 may be rotatably attached, by rivets for example, to the base bracket 50. In the illustrated embodiment, two securing straps 98 are provided for each shim 32. One securing strap 98 may be for attachment to the respective interior and exterior sheathing 30 of the rough opening 24 (FIG. 2). By rotatably mounting the securing straps 98 to the base bracket 50, the straps 98 can be rotated substantially parallel with the length of a corresponding frame member 34 during shipping and handling. Thus, the straps 98 may be generally positioned out of the way, and not projecting past the interior or exterior edges of the pre-hung door 10, prior to installation. Once the pre-hung door 10 is properly positioned within the rough opening 24 using one or both of the first and second adjustment screws 76, 92, the straps 98 can be rotated to extend along the plumb direction. The straps 98 can then be bent away from the frame member 34 along the margin direction to overlap both the exterior sheathing 30 and rough stud's interior edge.

Figure 9:
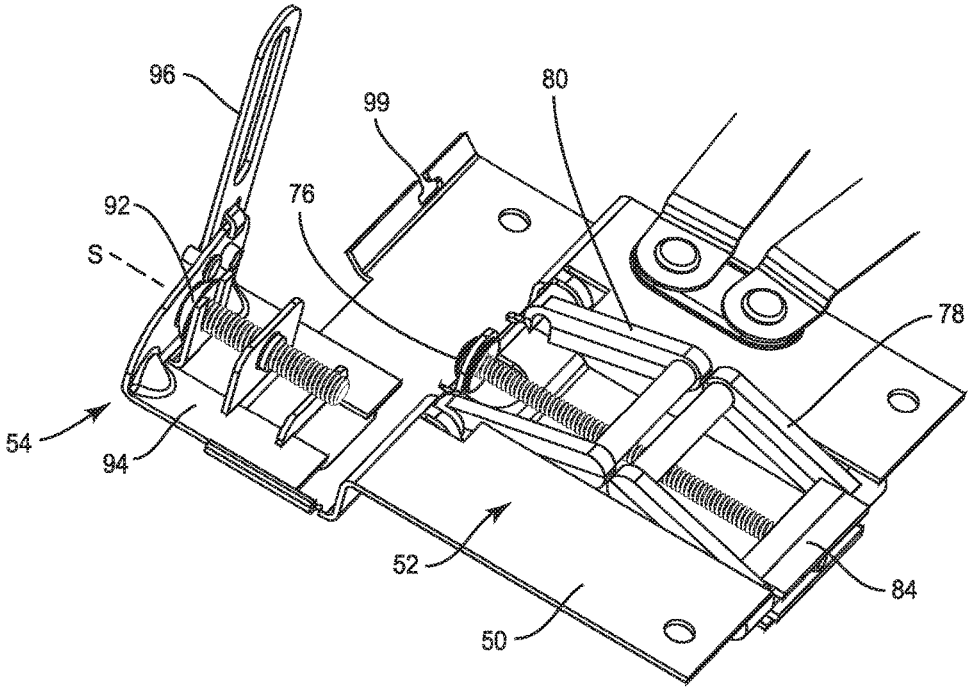
FIG. 9 is a second detailed perspective view of the adjustable shim of FIG. 5 with the shim plate removed.
Figure 10:
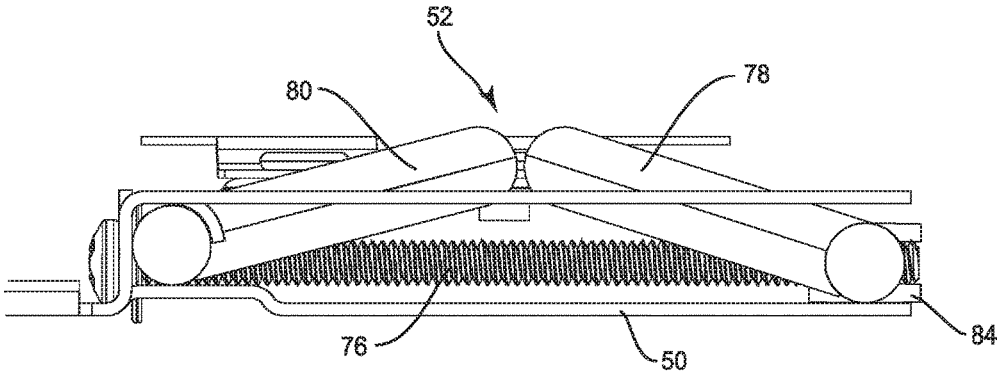
FIG. 10 is a detailed side view of the adjustable shim of FIG. 9.
Figure 11:
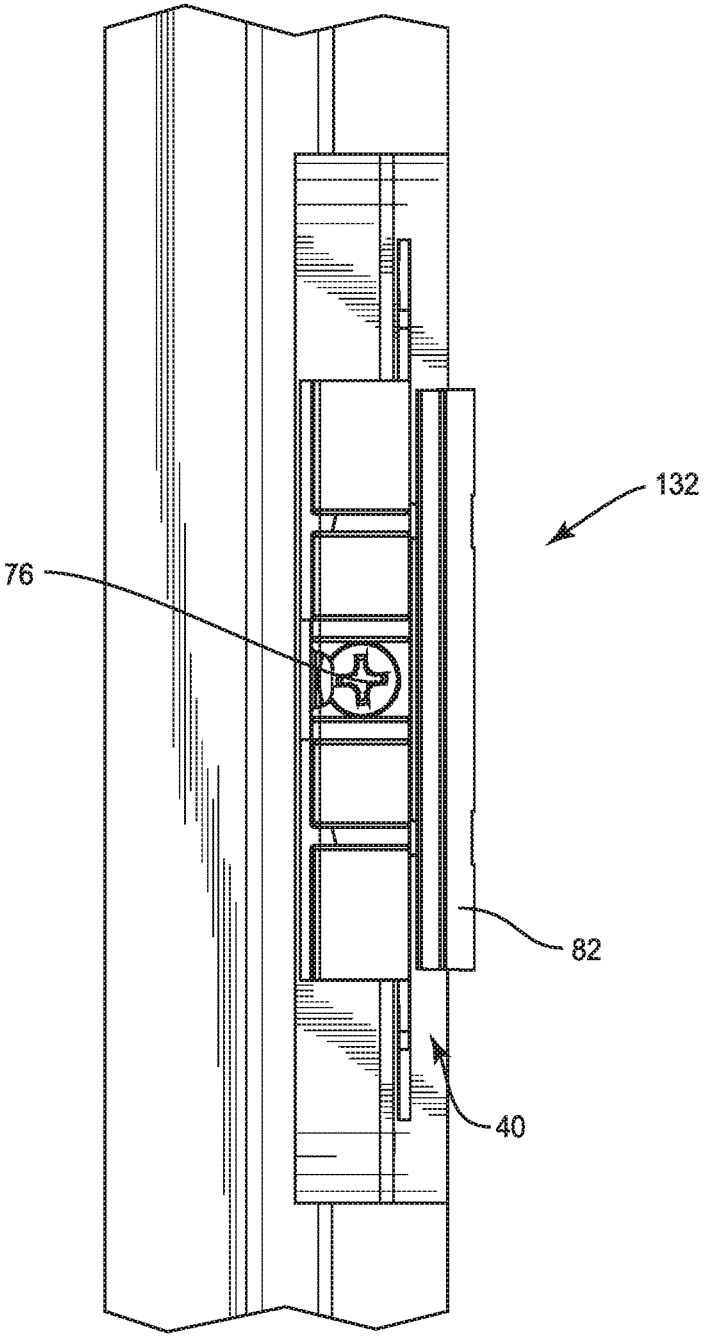
FIG. 11 is a detailed front view of an adjustable shim according to a second embodiment mounted to a frame member.
Figure 12:
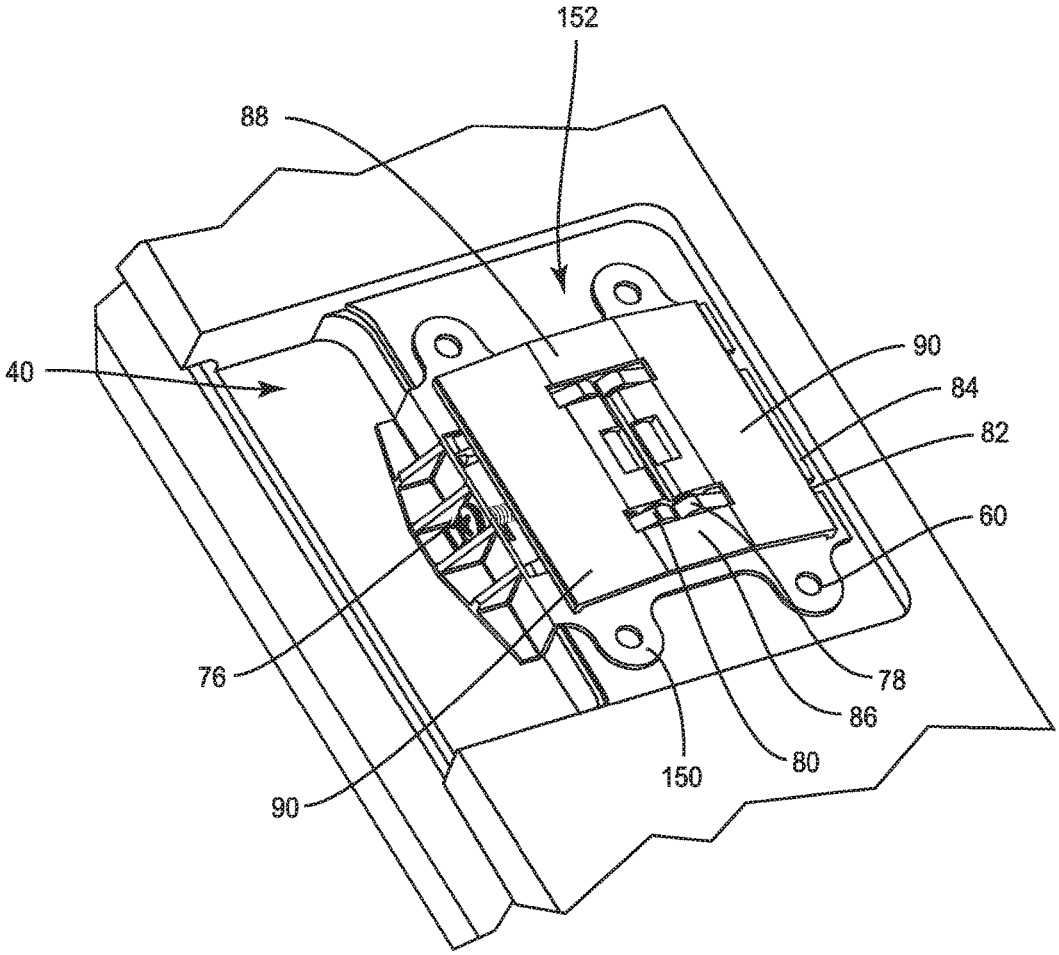
FIG. 12 is a perspective view of an adjustable shim mounted to a frame member of a pre-hung door according to the second embodiment.
Figure 13:
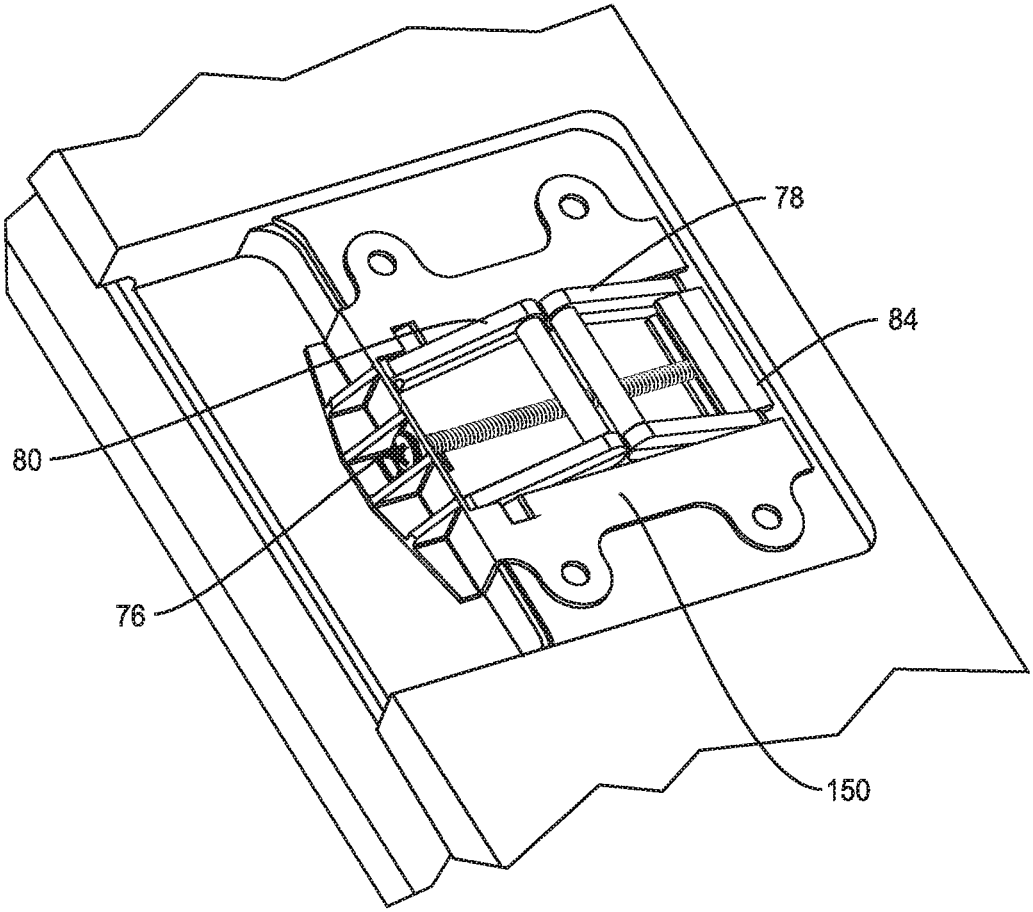
FIG. 13 is a detailed perspective view of the adjustable shim of FIG. 12 with the shim plate removed.
Figure 14:
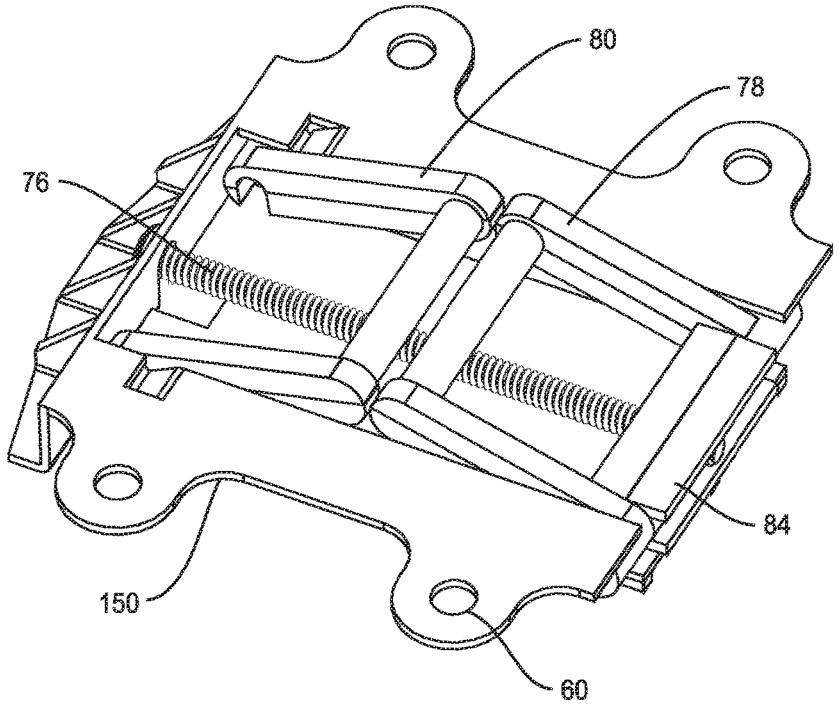
FIG. 14 is a second detailed perspective view of the adjustable shim of FIG. 12 with the shim plate removed.
Figure 15:
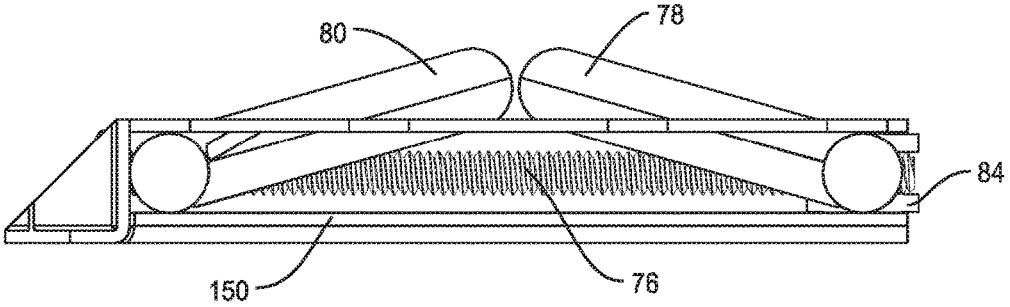
FIG. 15 is a side view of the adjustable shim of FIG. 14.

As possibly best shown in FIG. 9, the shim 32 may be provided with optional features that may assist an installer to assess the planar condition of the pre-hung door 10. For example, the base bracket 50 may include a slot 99. The slot 99 is configured to receive and secure an end of a string, or similar cord, rope, etc. When the pre-hung door 10 is provided with shims 32 near the four corners thereof, as shown in FIG. 2, a string 176 may be attached to span between the shim 32 at one upper corner of the pre-hung door 10, and the shim to the opposing diagonal lower corner of the pre-hung door. A another string 178 may be placed likewise between slots 99 in shims 32 at the remaining two corners. The pre-hung door 10 is then determined to be in a substantially planar condition if the two strings 176, 178 almost touch or lightly touch as they cross one another.

A second embodiment of an adjustable shim 132 is illustrated in FIGS. 11-15. The second embodiment of the adjustable shim 132 omits the plumb adjustment assembly and the securing straps of the first embodiment discussed above, thereby allowing for a slightly modified base bracket 150 (FIG. 12), which may be preferably a polymer material. The adjustable shim 132 may be useful at locations where the pre-hung door 10 (FIG. 2) does not need to be anchored to the rough opening 24. The adjustable shim 132 may be installed in a recess 40 having the same configuration as shown in FIG. 3. The margin adjustment assembly 152 (FIG. 12) of the adjustable shim 132 is substantially similar to the margin adjustment assembly 52 of the adjustable shim 32 shown in FIGS. 5-10, as will be understood by one of ordinary skill in the art. One of ordinary skill in the art will also appreciate that a pre-hung door 10 (FIG. 2) may be configured to have a combination of adjustable shims with both first adjustable shims 32 and second adjustable shims 132 present.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. An adjustable shim, comprising:

a base bracket configured for mounting to a frame member of a pre-hung door or window;

a shim plate; and an actuator operably attached between the base bracket and the shim plate, wherein rotation of the actuator raises or lowers the shim plate relative to the base bracket, wherein the actuator comprises: a pair of jack legs attached to the shim plate, wherein the jack legs are driven by a slide block translated along an adjustment screw, wherein one of the pair of jack legs is pivotably attached to the slide block to provide a drive linkage, and one of the pair of jack legs is pivotably attached between the base bracket and the shim plate as a follower linkage, and wherein a shimming surface of the shim plate comprises a plurality of faces, wherein the plurality of faces are not co-planar.

2. The adjustable shim of claim 1, wherein the adjustment screw translates the slide block linearly to result in either an increase or decrease in a shim height.

3. The adjustable shim of claim 1, wherein the plurality of faces comprise a central face flanked by a pair of side faces, wherein the side faces are angled toward the base bracket relative to the central face.

4. The adjustable shim of claim 1, wherein an adjustment range of a shim height is approximately ⅝ inches.

5. The adjustable shim of claim 1, further comprising a plumb adjustment assembly configured to adjust the frame member along an interior and exterior direction of a rough opening.

6. The adjustable shim of claim 5, wherein the plumb adjustment assembly includes an adjustment screw.

7. The adjustable shim of claim 1, further comprising at least one securing strap pivotable relative to the base bracket for securing the adjustable shim to the rough opening.

8. A pre-hung door comprising:

a frame;

a door panel hinged to the frame; and at least one adjustable shim attached to the frame, wherein the at least one adjustable shim comprises:

a base bracket mounted to the frame;

a shim plate; and an actuator operably attached between the base bracket and the shim plate, wherein rotation of the actuator raises or lowers the shim plate relative to the base bracket, wherein the actuator comprises: a pair of jack legs attached to the shim plate, wherein the jack legs are driven by a slide block translated along an adjustment screw, wherein one of the pair of jack legs is pivotably attached to the slide block to provide a drive linkage, and one of the pair of jack legs is pivotably attached between the base bracket and the shim plate as a follower linkage, and wherein a shimming surface of the shim plate comprises a plurality of faces, wherein the plurality of faces are not co-planar.

9. The pre-hung door of claim 8, wherein the frame comprises a header and a pair of jambs, wherein each of the header and the pair of jambs includes a back face which faces away from the door panel, wherein at least one of the pair of jambs or the header comprises at least one recess in the back face thereof, wherein the at least one adjustable shim is mounted at least partially within the at least one recess.

10. The pre-hung door of claim 9, wherein the at least one recess is configured to receive the at least one adjustable shim such that the shim plate can be adjusted to a position that does not extend outward beyond the back face.

11. The pro-hung door of claim 8, wherein the plurality of faces comprise a central face flanked by a pair of side faces, wherein the side faces are angled toward the base bracket relative to the central face.

12. The pre-hung door of claim 8, further comprising an adjustment screw configured to adjust the frame along an interior and exterior direction of a rough opening.

13. A method of installing a pre-hung door, the method comprising:

positioning the pre-hung door within a rough opening of a building, wherein the pre-hung door comprises at least one frame member, a door panel, and at least one adjustable shim mounted on a back face of the at least one frame member;

rotating a first actuator of the at least one adjustable shim to raise a shim plate of the at least one adjustable shim in a first direction relative to the back face of the at least one frame member at least until the shim plate contacts a portion of the rough opening;

attaching the at least one adjustable shim to the rough opening; and rotating a second actuator of the at least one adjustable shim to adjust the pre-hung door relative to the rough opening along a plumb direction perpendicular to the first direction.

14. The method of claim 13, wherein the at least one adjustable shim further comprises at least one securing strap, and the method further comprises securing the pre-hung door relative to the rough opening with the at least one securing strap.

* * * * *